US009993928B2

(12) United States Patent
Sablatschan

(10) Patent No.: US 9,993,928 B2
(45) Date of Patent: Jun. 12, 2018

(54) CUTTING ASSEMBLY FOR A HAIR CLIPPING DEVICE

(71) Applicant: KONINKLIJKE PHILIPS N.V., Eindhoven (NL)

(72) Inventor: Siegfried Sablatschan, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days. days.

(21) Appl. No.: 14/653,937

(22) PCT Filed: Sep. 17, 2013

(86) PCT No.: PCT/EP2013/069190
§ 371 (c)(1),
(2) Date: Jun. 19, 2015

(87) PCT Pub. No.: WO2014/095101
PCT Pub. Date: Jun. 26, 2014

(65) Prior Publication Data

US 2015/0328785 A1 Nov. 19, 2015

(30) Foreign Application Priority Data

Dec. 20, 2012 (EP) ..... 12198305

(51) Int. Cl.
*B26B 19/06* (2006.01)

(52) U.S. Cl.
CPC ..... *B26B 19/06* (2013.01)

(58) Field of Classification Search
CPC ..... B26B 19/00; B26B 19/02; B26B 19/04; B26B 19/042; B26B 19/06; B26B 19/063;
(Continued)

(56) References Cited

U.S. PATENT DOCUMENTS 2,200,150 A * 5/1940 Burch ..... B26B 19/066 30/223
2,271,053 A * 1/1942 Wahl ..... B26B 19/40 30/224
(Continued)

FOREIGN PATENT DOCUMENTS

DE 2646818 A1 5/1977
DE 202008002467 U1 4/2008
(Continued)

OTHER PUBLICATIONS https://en.oxforddictionaries.com/.*

*Primary Examiner* — Jennifer Swinney
*Assistant Examiner* — Richard Crosby, Jr.

(57) ABSTRACT

The present invention relates to a cutting assembly (10) for a hair clipping device (100), comprising: —a stationary cutting blade (12) having a first cutting edge (20), and a moveable cutting blade (14) that is resiliently biased against the stationary cutting blade (12) and has a second cutting edge (22) that is arranged parallel to the first cutting edge (20), wherein one of the cutting blades (12, 14) comprises at least one slot (42, 42') for compensating a stress-induced warpage within said cutting blade (12, 14), wherein said at least one slot (42, 42') extends substantially parallel to the two cutting edges (20, 22).

14 Claims, 4 Drawing Sheets

(58) Field of Classification Search
CPC ..... B26B 19/066; B26B 19/10; B26B 19/102; B26B 19/105; B26B 19/107
USPC ..... 30/208–210, 215–220
See application file for complete search history.

(56) References Cited

U.S. PATENT DOCUMENTS 2,291,439 A * 7/1942 Andis ..... B26B 19/06 30/123
2,292,364 A * 8/1942 Cromonic ..... B26B 19/205 30/201
2,484,610 A * 10/1949 Cromonic ..... B26B 19/06 30/210
3,144,714 A * 8/1964 Beisma ..... B26B 19/042 30/43.92
3,747,212 A * 7/1973 Krayl ..... B26B 19/06 30/221
3,962,783 A 6/1976 Rentema
3,962,785 A * 6/1976 Poel ..... B26B 19/06 30/223
4,221,050 A * 9/1980 Walter ..... B26B 19/20 30/216
4,458,417 A * 7/1984 Andis ..... B26B 19/06 30/216
4,805,300 A * 2/1989 Miska ..... B26B 19/04 30/34.1
4,860,452 A * 8/1989 Guarnaccia ..... B26B 21/56 30/346.5
5,504,997 A * 4/1996 Lee ..... B26B 19/02 30/34.1
5,579,581 A * 12/1996 Melton ..... B26B 19/063 30/223
D497,219 S * 10/2004 Branden ..... A47L 13/08 D28/47
7,080,458 B2 * 7/2006 Andis ..... B26B 19/06 30/208
7,340,839 B2 * 3/2008 Oh ..... B26B 19/06 30/208
7,954,243 B2 6/2011 De Wit
8,132,332 B2 * 3/2012 Tautscher ..... B26B 19/06 30/208
8,146,254 B2 * 4/2012 Morisugi ..... B26B 19/06 30/216
8,806,757 B2 * 8/2014 Moseman ..... B26B 19/205 30/208
2003/0200077 A1 10/2003 Leacock
2006/0042096 A1 * 3/2006 Liao ..... B26B 19/06 30/223
2006/0230621 A1 * 10/2006 Liao ..... B26B 19/06 30/223
2008/0040927 A1 * 2/2008 Lau ..... B26B 19/14 30/34.1
2008/0168658 A1 * 7/2008 Chen ..... B26B 19/042 30/45
2011/0061241 A1 3/2011 Jian
2011/0265331 A1 11/2011 Moseman
2015/0328785 A1 11/2015 Sablatschan

FOREIGN PATENT DOCUMENTS

EP 0181288 A2 5/1986
EP 1120206 A1 8/2001
JP 5649181 A 5/1981
WO 9847673 A1 10/1998
WO 0200402 A1 1/2002

* cited by examiner

CUTTING ASSEMBLY FOR A HAIR CLIPPING DEVICE

This application is the U.S. National Phase application under 35 U.S.C. § 371 of International Application No. PCT/EP2013/069190, filed on Sep. 17, 2013, which claims the benefit of European Application No. 12198305.0 filed on Dec. 20, 2012. These applications are hereby incorporated by reference herein.

FIELD OF THE INVENTION

The present invention relates to a cutting assembly for a hair clipping device. Further, the present invention relates to a cutting blade for such a cutting assembly and to a hair clipping device, in which such a cutting assembly is used.

BACKGROUND OF THE INVENTION

Electric haircutting appliances are generally known and include trimmers, clippers and shavers whether powered by main supplied electricity or batteries. Such devices are generally used to trim body hair, in particular facial and head hair to allow a person to have a well-groomed appearance. These devices can, of course, also be used to trim pet hair or any other type of hair.

Conventional haircutting devices comprise a main body forming an elongated housing having a front or cutting end and an opposite handle end. A cutting blade assembly is disposed at the cutting end. The cutting blade assembly usually comprises a stationary cutting blade and a moveable cutting blade. The moveable cutting blade moves in a reciprocal, translatory manner relative to the stationary cutting blade. The cutting blade assembly itself extends from the cutting end and is usually fixed in a single position relative to the main body of the hair clipper, such that the orientation of the cutting blade assembly is determined by a user orientating the main body of the device.

In common cutting blade units the cutting force driving the moveable cutting blade is usually transmitted through an electric motor driven eccentric. This eccentric is driven by an electric motor in a rotary manner. The rotary movement of the eccentric is then translated via a so-called driving bridge, which is connected to the moveable cutting blade, into the resulting reciprocal, translatory movement of the moveable cutting blade.

A common problem that occurs in such hair clipping systems is the so-called pulling effect. The pulling effect is an unwanted lifting of the moveable cutting blade from the stationary cutting blade, which may especially occur during heavy load hair cutting. A reason for this pulling effect is the occurrence of a torque or twisting action on the moveable cutting blade that may cause a tilt of the moveable cutting blade. The evenness of the stationary and the moveable cutting blade, i.e. the evenness of the top surfaces of the stationary and the moveable cutting blade, have a strong influence on the redoubtable pulling effect. It is therefore desired that the top surfaces of the cutting blades are as even as possible. However, in common cutting units the manufacturing process does not allow to have perfectly even cutting blades. The best results in manufacturing are reached with an additional grinding step at the end of the manufacturing process. Even with such an additional grinding step the evenness deviation is, however, in a range of about 5 μm for each cutting blade. In the worst case the warpages of both cutting blades add up positively, so that an evenness deviation of up to 10 μm or more could result therefrom. This causes a so-called diagonal warpage in one or both cutting blades during the assembly.

As soon as the moveable cutting blade is driven in the above-mentioned reciprocal manner, a small gap between the two cutting blades will occur. This can cause the above-mentioned fishtailing, lifting or tilting of the moveable cutting blade, which is known as pulling effect. This pulling effect especially occurs under heavy load conditions, e.g. maximum quantity, tightness, length, thickness and/or shape of the hairs. For every home user, professional hair and beard trimmer and also for the hair cutting of pets the pulling effect is redoubtable as it may generate remarkable hurt by pulling hairs into the device instead of cutting them. The pulling effect therefore also degrades cutting performance and may increase noise, wear and tear. Expertise for the above-mentioned pulling effect is known from the applicant's research as well as from other professionals in hair clipping.

A lot of prior art hair clipping devices try to overcome this effect by applying a very strong spring, which presses the two cutting blades against each other. The force applied by the spring shall impede a lifting or tilting of the moveable cutting blade. The spring force is also used to compensate for the manufacturing-related warpages within the cutting blades.

An example of such a cutting unit for a hair clipping device is known from U.S. 2011/0061241 A1. Therein, an adjustable screw is used with which the pressure between the stationary cutting blade and the moveable cutting blade may be manually adapted. However, if the pressure between the stationary cutting blade and the moveable cutting blade is increased, the friction between the two cutting blades will be increased as well. This increased friction often makes oiling necessary. Besides that it increases the abrasion of the two cutting blades.

The increased friction also requires the appliance of an enlarged electric motor. Such an enlarged electric motor is on one hand expensive and on the other hand also voluminous. It increases the overall size of the hair clipping device as well as it increases the production costs. Apart from that the power consumption of such enlarged electric motors is also higher than for hair clipping devices using smaller electric motors. This is especially disadvantageous for battery-driven hair clipping devices which in turn have shorter operating times.

EP 1 120 206 A1 discloses a blade block of a hair cutter including a fixed blade, a movable blade reciprocating with respect to the fixed blade, and a blade base to which the fixed blade and the movable blade are attached. The fixed blade and the movable blade are assembled with a reciprocating guide unit into a blade unit. The reciprocating guide unit guides the movable blade to reciprocate with respect to the fixed blade. The blade block includes an insertion opening. A mounting unit is provided to mount the blade unit to the blade base by inserting the blade unit into the insertion opening so that a cutting edge is exposed to the outside of the blade block.

SUMMARY OF THE INVENTION

Therefore, it is an object of the present invention to provide a cutting assembly for a hair clipping device which overcomes the above-mentioned disadvantages of the state of the art hair clipping devices. In particular, it is an object to provide a cutting assembly that overcomes the problematic pulling effect and at the same time preferably allows the usage of smaller motors for driving the moveable cutting blade. The abrasion shall also be reduced for the newly provided cutting assembly.

The above-mentioned problem is solved by a cutting assembly for a hair clipping device, comprising:

a stationary cutting blade having a first cutting edge, and a moveable cutting blade that is resiliently biased against the stationary cutting blade and has a second cutting edge that is arranged parallel to the first cutting edge, wherein one of the cutting blades comprises two slots for compensating a stress-induced warpage within said cutting blade, wherein said two slots are aligned with each other and extend parallel to the two cutting edges.

According to a further aspect of the present invention, the above-mentioned problem is solved by a cutting blade for such a cutting assembly, wherein the cutting blade comprises a cutting edge and two slots for compensating a stress-induced warpage within said cutting blade, wherein said two slots are aligned with each other and extend parallel to the cutting edge.

According to a still further aspect of the present invention, the above-mentioned problem is solved by a hair clipping device comprising the above-mentioned cutting assembly.

Preferred embodiments of the invention are defined in the dependent claims. It shall be understood that the claimed cutting blade and the claimed hair clipping device have similar and/or identical preferred embodiments as the claimed cutting assembly and as defined in the dependent claims.

The cutting assembly according to the present invention comprises a new design of the cutting blades. Either the stationary cutting blade or the moveable cutting blade comprises at least one slot for compensating the warpage within said cutting blade which may occur due to an unevenness in one or both cutting blades that results from manufacturing tolerances/inaccuracy. The at least one slot within one of the cutting blades allows for an elastic compensation of a gap that may occur between the two cutting blades due to said unevenness. The slot therefore compensates a stress-induced warpage within the corresponding cutting blade. The at least one slot allows the corresponding cutting blade to more or less elastically flex. This increased flexibility compensates the occurring warpage and therefore minimizes the risk that the pulling effect occurs.

The increased flexibility that is caused by the at least one slot within one of the cutting blades may be adjusted by the length and size of the at least one slot. On the one hand the slot should not be too large, since otherwise the stiffness, especially along the symmetry axis of the cutting blade would get lost. A too small slot would on the other hand not allow enough flexibility to compensate for the warpage of the cutting blade during an operation of the hair clipping device. Therefore there must be a balance between the stiffness along the symmetry axis and the allowed elastic deformation of the cutting blade that comprises the at least one slot.

The design of the slot must also consider that the force transmission of the spring that presses the moveable cutting blade against the stationary cutting blade is still large enough for a sufficient teeth pressure, i.e. the pressure at the cutting edges of both cutting blades with which they are pressed together. Due to the presented warpage compensation the two cutting blades do not have to be biased against each other so strongly as this is needed in most of the conventional cutting assemblies according to the prior art. Thus, friction between the two cutting blades may be reduced, so that in summary a better cutting performance may be achieved with smaller motors, less energy consumption by still avoiding the redoubtable pulling effect.

The possibilities where the at least one compensation slot can be locally placed are almost unlimited. It should be made sure that the at least one compensation slot extends substantially parallel to the two cutting edges. In other words, the cross section of the at least one slot is arranged perpendicular to the two cutting edges.

It shall be noted that both cutting edges, the first cutting edge of the stationary cutting blade and the second cutting edge of the moveable cutting blade may either be designed as sharp and straight edges or as toothed edges with an array of teeth. In case of a toothed edge the first and second cutting edge shall denote the virtual straight line that connects the tip portions of each of the plurality of teeth. The at least one slot is therefore substantially parallel to this line/cutting edge.

Further, it shall be noted that the at least one slot cuts through the whole thickness of the corresponding cutting blade. The at least one slot may also be regarded as a slit. A simple notch that does not cut through the cutting blade but only forms a small groove within the cutting blade would instead not be enough for the above-mentioned warpage compensation, as it would not allow enough flexibility for the cutting blade to flex forth and back during operation.

According to an embodiment of the present invention, one of the cutting blades comprises two slots that are aligned with each other and both extending parallel to the two cutting edges.

In this embodiment, either the moveable cutting blade or the stationary cutting blade does not only comprise one slot, but two slots. These two slots are aligned with each other, i.e. both slots have the same distance to the two cutting edges.

According to a preferred embodiment, the two slots extend from two opposing lateral sides of the corresponding cutting blade toward a middle part of said cutting blade that bridges the two slots. The two slots are therefore separated from each other by said middle part. The first slot for example ranges from the first lateral side of the respective cutting blade towards the middle part and the second slot ranges from the second opposing lateral side of the respective cutting blade towards the middle part. The middle part forms a kind of bar between the two slots. This bar does not only bridge the two slots but also the two parts of the cutting blade that are separated from each other by the two slots. The middle part thus acts as a kind of torsion spring that compensates the warpage in the above-mentioned way by providing a mechanical flexibility to the respective cutting blade.

According to a further embodiment, said middle part is arranged on a symmetry axis of the corresponding cutting blade.

Since the middle part forms a kind of torsion spring as mentioned before, an arrangement on the symmetry axis of the cutting blade is especially advantageous as it provides a symmetric mechanical flexibility during the operation of the hair clipping device. As mentioned before, the two compensation slots and the middle part may be either arranged within the moveable cutting blade or within the stationary cutting blade. According to a preferred embodiment, the two slots as well as the middle part, which connects them, are arranged within the stationary cutting blade, which is usually also denoted as guard.

According to a further embodiment of the present invention, a width of said at least one slot measured in a direction perpendicular to the two cutting edges is small compared to a dimension of the corresponding cutting blade in the same direction. The width of said at least one slot is preferably within a range of 0.1 to 3 mm.

The two compensation slots are preferably realized as very thin slits within one of the two cutting blades. Too large slits would lead to an instability of the corresponding cutting blade, which would contravene the cutting performance. Very thin slots/slits are enough to compensate for any stress-induced warpage that may occur during operation. These slots/slits may be manufactured very easily. The slots/slits only have to be cut into the corresponding cutting blade starting at the two opposing lateral sides and continuing to cut parallel to the cutting edges towards the middle part that remains.

The prevention of the redoubtable pulling effect may even be more effective when combining the above-mentioned warpage compensation system with a gliding friction system between the two cutting blades.

According to an embodiment of the present invention, the cutting assembly further comprises at least one first ball bearing which is arranged between the stationary and the moveable cutting blade. This at least one first ball bearing guides the moveable cutting blade on the stationary cutting blade by at least one rolling ball.

In contrast to known hair clipping devices of the prior art, in which the moveable cutting blade usually glides on the stationary cutting blade, friction is thereby significantly reduced. As it is known, there is a huge difference between gliding and rolling friction. Gliding friction is usually calculated by $F_R=\mu \cdot F_N$, wherein the gliding friction coefficient $\mu$ for steel against steel is between 0.3 and 1.5; whereas rolling friction: $F_R=c_R \cdot F_N$, has a rolling friction coefficient $c_R$ for steel against steel between 0.001 and 0.0005.

The friction force in a rolling friction condition is thus only 3% from the comparable gliding friction force. The appliance of a ball bearing between the moveable cutting blade and the stationary cutting blade thus significantly benefits the frictional behaviour between the two cutting blades. By guiding the moveable cutting blade relative to the stationary cutting blade with, for example, two ball bearings, the tip-to-tip distance (distance between the two cutting edges) is also remained constant during the movement of the moveable cutting blade. Due to the reduced friction (rolling friction) the power consumption of the electric motor is also reduced. This also decreases the risk of the above-mentioned unwanted pulling effect. It gives the consumer the reliability that the user gets not hurt through a pulled cutting element while cutting his/her hair. This increases the safety and confidence of the user to the hair cutting device. Besides that the reduced rolling friction may lead to higher cutting speeds compared to common hair clipping devices using the same type of electric motors as the force transmission from the electric motor to the moveable cutting blade is significantly improved. Together with the above-mentioned warpage compensation system realized through the at least one slot within one of the two cutting blades, the at least one first ball bearing almost completely prevents the risk of an occurring pulling effect.

According to a further embodiment, said at least one first ball bearing is arranged between two guiding recesses formed in the stationary cutting blade and in the moveable cutting blade, respectively, which two guiding recesses extend parallel to the two cutting edges. The two guiding recesses are preferably arranged across each other and the ball of the ball bearing is arranged in between.

Common cutting units are designed with a guiding of the movement by levers of a spring that presses the moveable cutting blade against the stationary cutting blade. These levers of the spring increase the clamping force between the moveable and the stationary cutting blade. Some cutting elements are guided by a guiding with a plastic engagement of the driving bridge into a rectangular slot of the stationary cutting blade. In these cases the guiding part needs more space for movement, because gliding friction exists.

The herein proposed ball bearings instead give the lowest possible rolling friction. Cutting tests with the hair clipping device according to the present invention have shown remarkably good performance under extreme tight hairs, an extreme quantity of hairs or under other difficult operating conditions. The device according to the present invention has shown perfect haircut results without the occurrence of the redoubtable pulling effect.

According to a further embodiment, a distance of said two guiding recesses to the cutting edges is larger than a distance between the at least one slot and the cutting edges. The ball bearing is thus arranged on a side of the at least one slot that is averted from the cutting edges. In other words, the at least one slot divides the respective cutting blade in two parts, one part that includes the cutting edge and the other part which includes a guiding recess that runs parallel to the cutting edge.

According to a further embodiment, the cutting assembly may comprise at least one second ball bearing which is arranged between the stationary cutting blade and the moveable cutting blade, wherein the at least one first ball bearing and the at least one second ball bearing are arranged on different sides of the at least one slot. A variation with three ball bearings is especially preferred since this leads to a statically determined condition. For example, two ball bearings may be arranged between the at least one slot and the cutting edge of the moveable cutting blade and the third ball bearing may be arranged on the other side of the at least one slot, i.e. on the rear side of the cutting assembly. However, the arrangement of the three ball bearings may also be the other way-around, i.e. one ball bearing between the at least one slot and the cutting edge of the moveable cutting blade and two ball bearings on the rare side of the cutting assembly.

In all above-mentioned placement variations of the ball bearings, it is preferred that the center of the at least one first ball bearing and/or the center of the at least one second ball bearing is arranged within the cutting plane (cutting level). This has the technical effect that no tilting moments or overturning torques act on the ball bearings as they are arranged within the cutting level in which the driving force is transmitted.

BRIEF DESCRIPTION OF THE DRAWINGS

These and other aspects of the invention will be apparent from and elucidated with reference to the embodiment(s) described hereinafter. In the following drawings

DETAILED DESCRIPTION OF THE INVENTION

Figure 1:
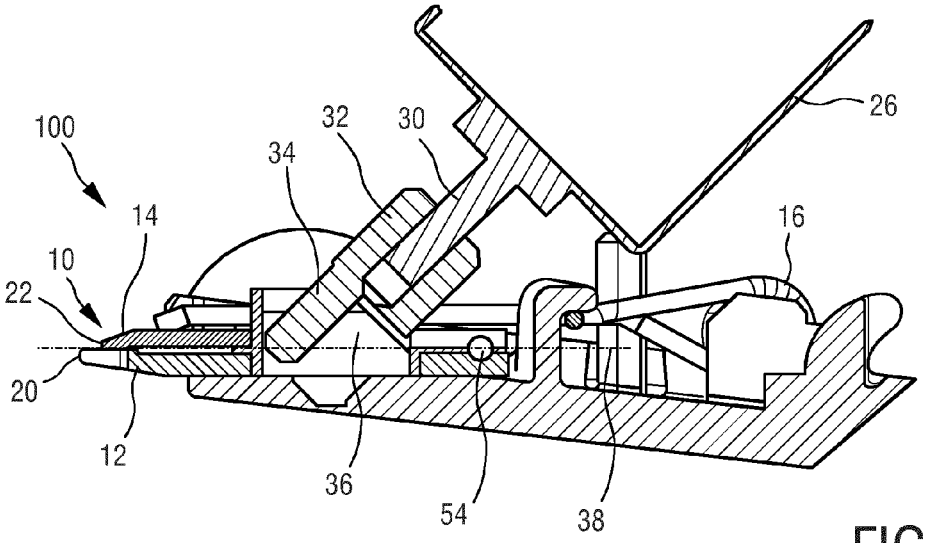
FIG. 1 shows a sectional view of an embodiment of a hair clipping device according to the present invention.
Figure 2:
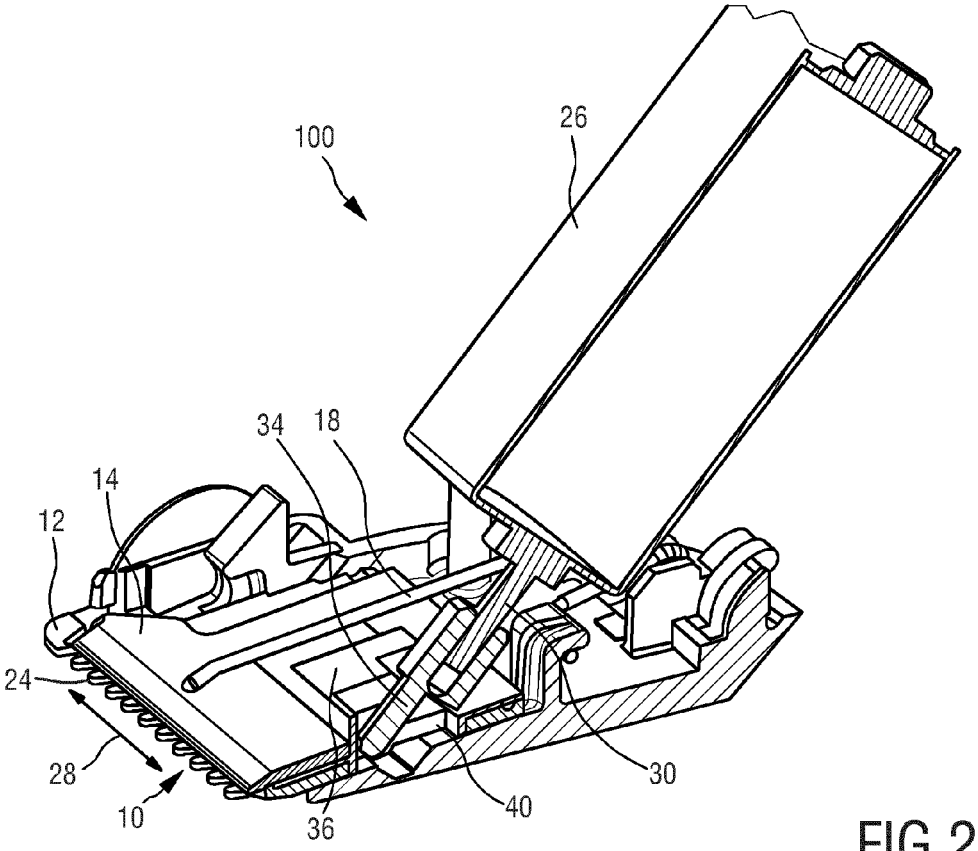
FIG. 2 shows a perspective sectional view of the embodiment shown in FIG. 1 of the hair clipping device according to the present invention.

FIGS. 1 and 2 schematically illustrate the principle design of a hair clipping device according to the present invention. The hair clipping device is therein in its entirety denoted with reference numeral 100.

The hair clipping device 100 according to the present invention usually comprises a housing (not explicitly shown) in which all remaining parts are usually integrated. The housing also serves as a holder for a cutting assembly 10. The housing usually has an elongated body, wherein the cutting assembly 10 is releasably fixed to a front end of said housing. The cutting assembly 10 may of course also be permanently fixed to the front end of the housing. The housing may further comprise a handle at its rear end (not shown).

The cutting assembly 10 includes a stationary cutting blade 12 and a moveable cutting blade 14. The moveable cutting blade 14 is displaceably mounted on an upper surface of the stationary cutting blade 12, which upper surface faces substantially towards the inner side of the housing. By the help of a spring 16 the moveable cutting blade 14 is resiliently biased against the stationary cutting blade 12. This spring 16 may be realized as a mechanical spring that comprises two spring levers 18, 18'. These spring levers 18, 18' exert a spring force onto the moveable cutting blade 14 in order to keep the two cutting blades 12, 14 close together. The stationary cutting blade 12 comprises a first cutting edge 20 and the moveable cutting blade 14 comprises a second cutting edge 22 that runs parallel to the first cutting edge 20. Both the first and the second cutting edges 20, 22 may be toothed cutting edges having an array of teeth. Alternatively, they may also be designed as a sharp continuous cutting edge as this is illustrated in FIG. 2 exemplarily for the moveable cutting blade 14. It shall be noted that in case of toothed cutting edges the "cutting edge" shall denote the front part of the teeth, i.e. an imaginary line that connects the tip portions 24 of each of the plurality of teeth with each other (see FIGS. 4*a* and 5*b*).

During operation haircutting is performed by the interaction of the stationary cutting blade 12 and the moveable cutting blade 14 that reciprocates on the stationary cutting blade 12 as this is known from other conventional hair clipping devices.

The stationary cutting blade 12 is usually designed to be thicker than the moveable cutting blade 14. Said stationary cutting blade 12 is also denoted as "guard". In order to receive a good cutting performance, the moveable cutting blade 14 is actively pressed onto the upper surface of the guard 12 to receive a so-called teeth pressure. This teeth pressure is, inter alia, guaranteed by the above-mentioned spring 16 that presses the two cutting blades 12, 14 together.

A drive arrangement including a motor 26 is adapted to drive the moveable cutting blade 14 in an oscillatory manner in an opposing movement direction 28. This movement direction 28 is arranged parallel to the first and second cutting edges 20, 22. The motor 26 thereto comprises a rotary driven shaft 30 that is forced into rotation. An eccentric transmission element 32 including an eccentric pin 34 protruding therefrom is arranged on said rotary driven shaft 30. The eccentric transmission element 32 may be clamped onto the shaft 30 or coupled to it in any other way. However, the shaft 30 and the eccentric transmission element 32 may also be realized as one integrated part. The motor 26 itself may, for example, be realized as an E-motor that is either powered by main supplied electricity or battery-driven.

The rotary movement of the eccentric transmission element 32 is translated into the translatory movement of the moveable cutting blade 14 via a coupling element 36. The coupling element 36 is usually called "driving bridge". In contrast to state of the art hair clipping devices, where said driving bridge 36 is mounted on the top surface of the moveable cutting blade 14, the driving bridge is integrated into the cutting assembly 10. The driving bridge 36 is therefore arranged at a spatially lower position with respect to the cutting assembly 10. The eccentric transmission element 32 may also be arranged at a spatially lower position as in prior art hair clipping devices. Said eccentric transmission element 32 engages the coupling element 36 at a position that is very close to or even lies within the cutting level 38. The cutting level 38, which is also referred to as cutting plane 38, defines an imaginary plane between the stationary cutting blade 12 and the moveable cutting blade 14 along which both blades 12, 14 contact each other.

In order to guarantee such a low arrangement of the coupling element/driving bridge 36, the driving bridge 36 is arranged in a recess 40 that cuts through the stationary and the moveable cutting blades 12, 14. This recess 40 builds an inclusion within the cutting assembly 10 for receiving the driving bridge 36.

The engagement point between the eccentric transmission element 32 and the driving bridge 36 may thus be arranged below the upper surface of the moveable cutting blade 14 and therefore very close to the cutting level 38. Ideally the engagement point lies directly within the cutting level 38. Such an arrangement of the engagement point within the cutting level 38 reduces the risk of an occurring overturning torque that may lead to a tilt of the moveable cutting blade 14. Such a tilt of the moveable cutting blade 14 is also known as pulling effect which significantly decreases the haircutting performance and may lead to a pulling-in of hair into the cutting assembly 10 instead of cutting the hairs. This is unpleasant for the user as a pulling-in of hair may hurt a lot.

Arranging the engagement of the eccentric transmission element 32 with the driving bridge 36 close to or even within the cutting level 38 leads to the fact that the transmission forces for driving the moveable cutting blade 14 are transmitted directly within the cutting level 38. A tilting moment that leads to a tilt of the moveable cutting blade 14 is therefore prevented.

A further central feature for preventing the mentioned pulling effect may be seen in FIGS. 3*a*, 3*b*, 3*c* and 4*a*, 4*b*, 4*c*. The stationary cutting blade 12 according to the present invention comprises two slots 42, 42'. These two slots 42, 42' extend substantially parallel to the two cutting edges 20, 22 of the cutting assembly 10. The slots 42, 42' are a means for compensating a stress-induced warpage within the stationary cutting blade 12. Without these slots 42, 42' such a stress-induced warpage could also lead to a lifting or tilting of the moveable cutting blade 14 and could therefore also be a reason for the occurrence of the pulling effect.

Said warpage within the stationary cutting blade 12 usually relates from inaccuracies during the manufacturing process. Even though the cutting blades 12, 14 are usually grinded at a late stage of the manufacturing process, it is not possible to get absolutely even surfaces of the cutting blades 12, 14. The surfaces of the cutting blades 12, 14 will therefore be slightly uneven. This unevenness could lead to a warpage within the cutting blades 12, 14 as soon as they are pressed against each other during the assembly. The unevenness of the stationary cutting blade 12 and the moveable cutting blade 14 may in the worst case result in a small gap between the two cutting blades 12, 14. This gap may also produce a gap between the cutting edges 20, 22. This gap again is the activator for lifting the moveable cutting blade 14 from the stationary cutting blade 12, which then causes the redoubtable pulling effect. A perfect evenness of the two cutting blades 12, 14 is not realistic or only achievable with complicated and cost intensive production steps. The inventors of the present invention have therefore found a simple and cost-saving solution by providing two compensation slots 42, 42' within the stationary cutting blade 12.

These two compensation slots 42, 42' increase the mechanical flexibility of the stationary cutting blade 12. Gaps that may occur due to manufacturing inaccuracies may thus easily be closed, since the stationary cutting blade 12 then acts as a kind of spring and may more easily adapt its shape to the corresponding shape of the moveable cutting blade 14. This enables to close the gap between the stationary cutting blade 12 and the moveable cutting blade 14, so that no gap occurs therein between anymore. The resilience of the stationary cutting blade 12 may be adjusted by the length and width of the two slots 42, 42'.

Figure 4A:
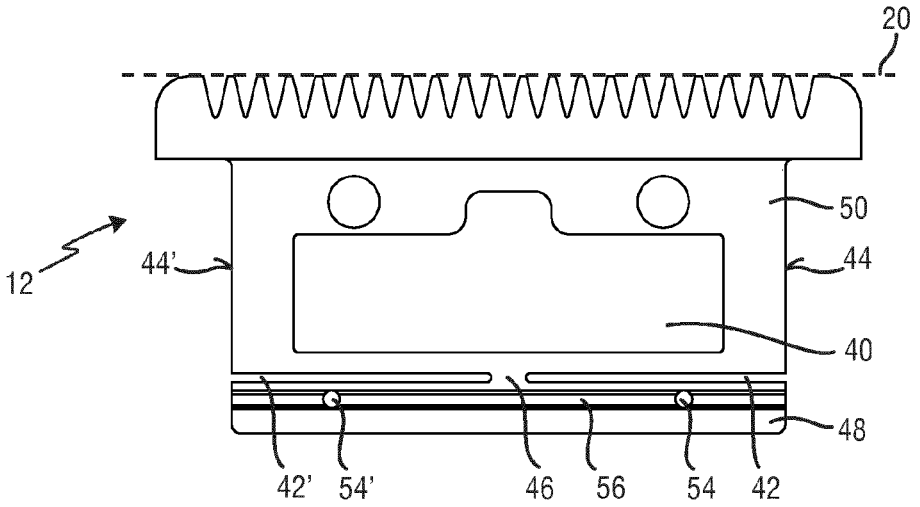
FIGS. 4*a*, 4*b* and 4*c* show different views of an embodiment of a stationary cutting blade that is used in the cutting assembly according to the present invention.
Figure 4B:
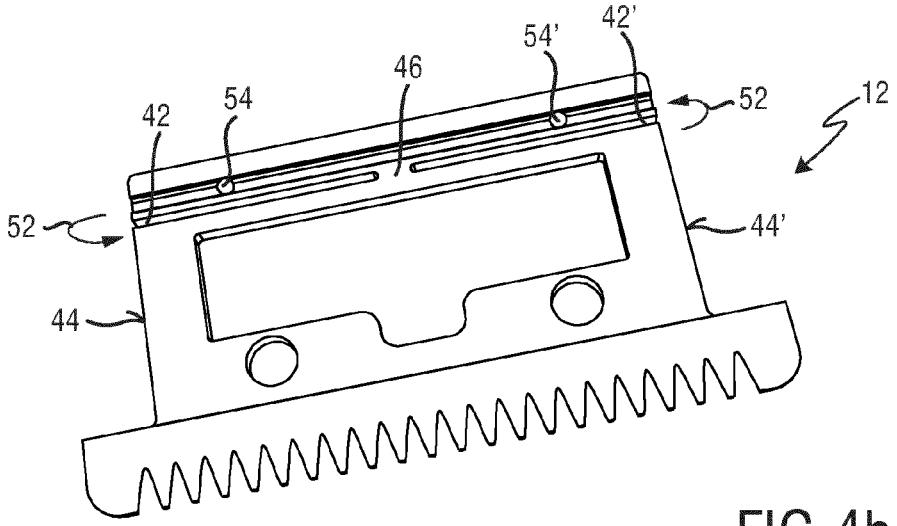
Figure 5A:
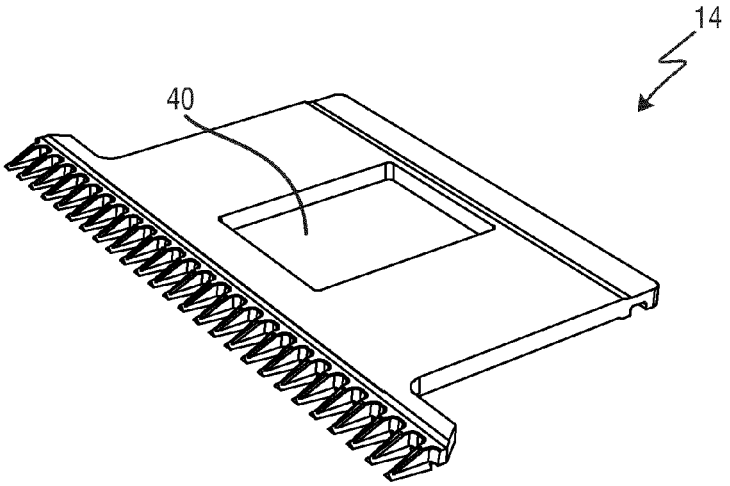
FIGS. 5*a*, 5*b* and 5*c* show different views of an embodiment of a moveable cutting blade that is used in the cutting assembly according to the present invention.
Figure 5B:
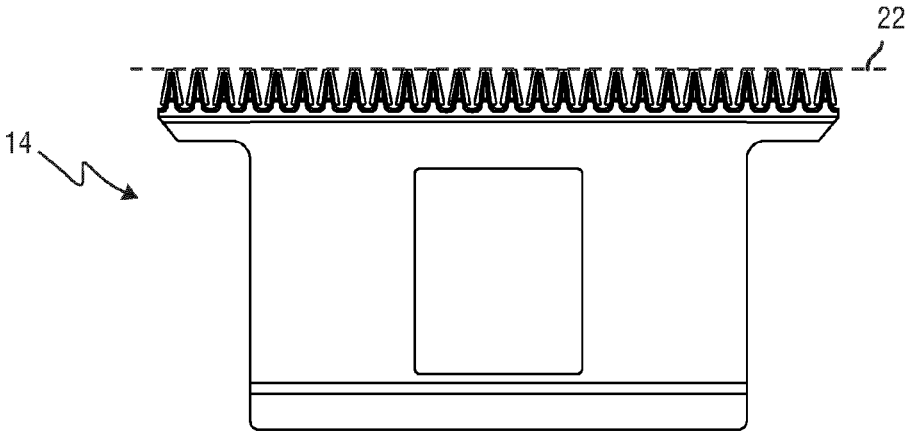

As it can be seen in FIGS. 4*a* and 4*b*, the two compensation slots 42, 42' are preferably aligned with each other and both extend parallel to the cutting edges 20, 22. Both slots 42, 42' preferably have the same distance from the first cutting edge 20. The two slots 42, 42' extend from two opposing lateral sides 44, 44' of the stationary cutting blade 12 toward a middle part 46 that bridges the two slots 42, 42'. This middle part 46 connects the rear part 48 and the front part 50 of the stationary cutting blade 12 with each other. The middle part 46 forms a bar that acts as a kind of torsion spring allowing the two parts 48, 50 of the stationary cutting blade 12 to bend or tilt relative to each other, as this is schematically illustrated by arrows 52. The stationary cutting blade 12 may thus compensate for the stress-induced warpage to close the gap between the two cutting edges 20, 22, such that the pulling effect is effectively prevented.

Figure 4C:
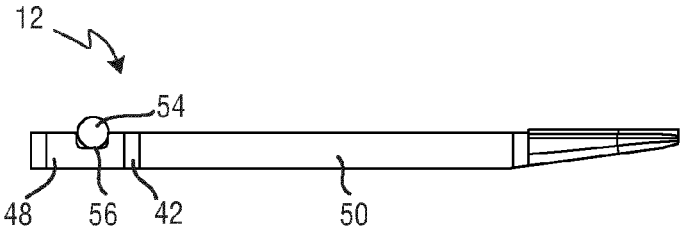

The two compensation slots 42, 42' are, as shown in FIGS. 4*a*, 4*b* and 4*c*, designed as slits that pass through the cross section of the stationary cutting blade 12. In other words, these slits 42, 42', in contrast to grooves, cut through the material of the stationary cutting blade 12. The first slot 42 preferably extends from the first lateral side 44 towards the middle part 46. The second slot 42' extends from the opposing second side 44' towards the middle part 46. A width of said two slots 42, 42' (measured in a direction perpendicular to the cutting edge 20) is small compared to a dimension of the stationary cutting blade 12 in the same direction. The slots 42, 42' preferably have a width that is in a range between 0.1 to 3 mm.

The above-mentioned "warpage compensation" using the two slots 42, 42' also has the advantage that a four-point bearing is realized between the stationary and the moveable cutting blade 12, 14. In prior art cutting assemblies usually a three-point bearing is realized. However, such a three-point bearing may easier lead to a tilt of the moveable cutting blade 14. A four-point bearing as realized here is more stable, even though it is statically overdetermined.

Figure 3A:
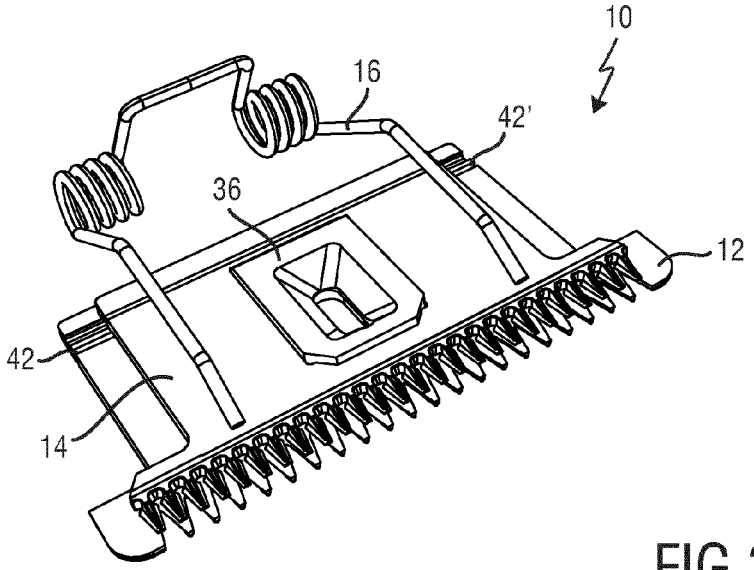
FIGS. 3*a*, 3*b* and 3*c* show different views of an embodiment of a cutting assembly according to the present invention.
Figure 3B:
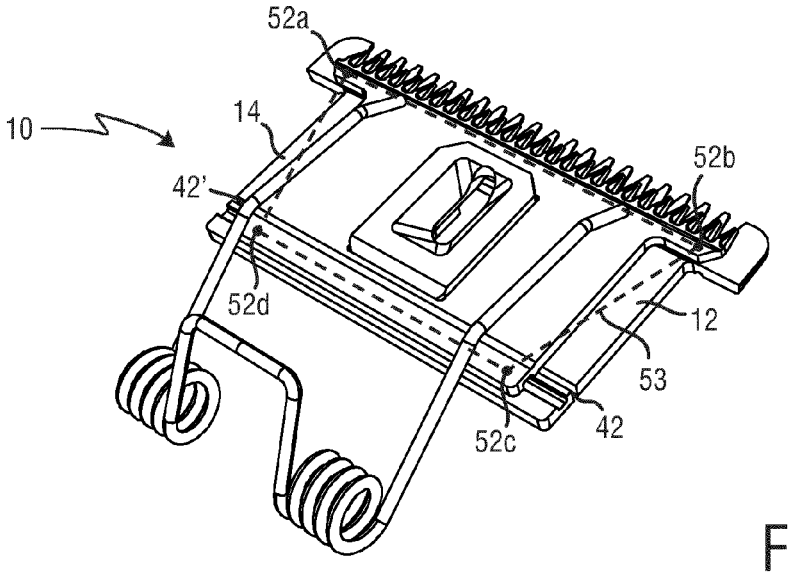

As shown in FIG. 3*b*, the moveable cutting blade 14 contacts the stationary cutting blade 12 at four points 52*a-c*, which leads to a force trapezoid that is indicated with dashed line 53. Since no force is transmitted outside this trapezoid 53, a very stable bearing between the two cutting blades 12, 14 is realized.

A further central point of the present invention relates to the guidance of the moveable cutting blade 14 on the stationary cutting blade 12. Compared to state of the art hair clipping devices, in which the moveable blades usually glide on the stationary blades so that gliding friction is produced therein between, the hair clipping device 100 according to the present invention comprises at least one ball bearing 54 between the moveable cutting blade 14 and the stationary cutting blade 12. This establishes a rolling friction between the two cutting blades 12, 14.

As friction forces accompanied with rolling friction are only 3% from the corresponding friction forces accompanied with gliding friction, the friction between the moveable and the stationary cutting blade 12, 14 is significantly reduced. Besides abrasion this also significantly reduces the noise level of the hair clipping device 100. Apart from that, less driving force is lost due to friction so that smaller e-motors may be applied or higher cutting speeds may be reached with the same e-motors.

Figure 3C:
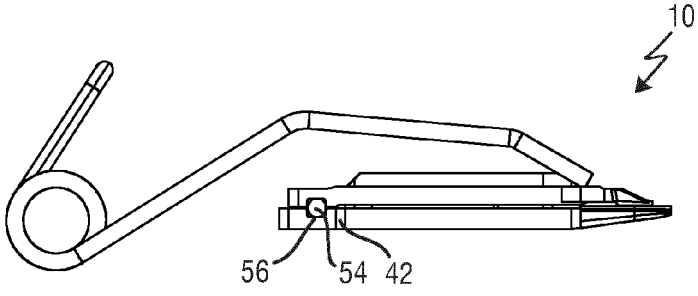
Figure 5C:
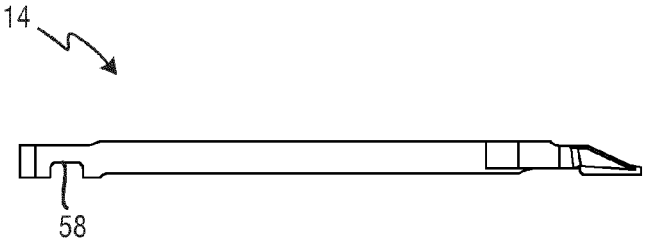

The ball bearing 54 is illustrated in FIG. 3*c*. As also shown in FIGS. 4*a* and 4*b*, preferably two ball bearings 54, 54' are provided. The two ball bearings 54, 54' are arranged on the teeth averted rear side of the cutting assembly 10. The balls of the ball bearings 54, 54' are guided in a guiding recess 56, which is formed in the stationary cutting blade 12, and in a corresponding guiding recess 58, which is formed parallel thereto into the moveable cutting blade 14 (see also FIG. 5*c*). Both guiding recesses 56, 58 preferably have a U-shaped cross section with vertical walls. They preferably run parallel to the two cutting edges 20, 22. The guiding recesses 56, 58 are arranged behind the two slots 42, 42' on the teeth averted rear side of the cutting blades 12, 14. In other words, the distance between said two guiding recesses 56, 58 and the cutting edges 20, 22 is larger than the distance between the two slots 42, 42' and the cutting edges 20, 22.

It is to be noted that also other variations and arrangements of the ball bearings 54 are possible. The position as well as the number of ball bearings may be varied and adapted to the specific needs. In a preferred embodiment the two guiding recesses 56, 58 are arranged on the same level as the driving bridge 36, more particularly on the same level with the engagement point between the eccentric pin 34 and the driving bridge 36. In other words, the guiding recesses 56, 58 preferably have the same distance to the cutting edges 20, 22 as said engagement point from the driving bridge 36. The main advantage of such an arrangement is that tilting moments, which may occur due to said engagement between the eccentric 34 and the driving bridge 36, may be compensated directly in the same level.

In summary, the present invention provides a cutting assembly for a hair clipping device which effectively overcomes the problem of an unwanted pulling of the moveable cutting blade. Due to the special technical design that is chosen in the presented hair clipping device, the hair clipping device is especially in terms of cutting performance, force transmission effectiveness, friction, wear and tear as well as in terms of noise level significantly improved. One of the central points is the compensation of the stress-induced warpage by means of at least one slot that is integrated into the stationary cutting blade. It is to be noted that the same technical effect occurs if the at least one slot is integrated into the moveable cutting blade. The at least one slot could thus also be arranged within the moveable cutting blade without leaving the scope of the present invention.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A cutting assembly for a hair clipping device comprising:

a first cutting blade having a first cutting edge and a second cutting blade having a second cutting edge, one of said blades being arranged to remain stationary during operation and the other one said blades being arranged to move against the stationary blade during operation to effect said hair clipping, the first cutting blade having a front portion and a rear portion disposed between opposing first and second lateral side edges and including first and second slots aligned with each other and in parallel with the first cutting edge, said first and second slots longitudinally cutting through the first cutting blade from the first and second lateral edges, respectively, to a bridge part disposed between said first and second slots, said bridge part connecting said front portion and said rear portion, said slot and bridge part structure enhancing the ability of portions of the first cutting blade connected to the bridge part to flex in response to an applied force; and a force-applying member coupled to one of the first and second cutting blades for resiliently applying a force urging the portions of the first cutting blade connected to the bridge part and the second cutting blade against each other, thereby compensating for warpages of the first and second butting blades relative to each other.

2. A cutting assembly for a hair clipping device as in claim 1 where the force-applying member comprises a spring.

3. A cutting assembly for a hair clipping device as in claim 1 where the bridge part enables both bending and torsional flexing of the portions of the first cutting blade connected to said bridge part.

4. A cutting assembly for a hair clipping device as in claim 1 where the first and second slots are slits cutting through the first cutting blade from the first and second lateral edges, respectively.

5. A cutting assembly according to claim 1 where the bridge part comprises a middle part of the first cutting blade.

6. A cutting assembly according to claim 5 where said middle part is arranged on a symmetry axis of the first cutting blade.

7. A cutting assembly according to claim 1 where each of the first and second slots has a width that is within a range of 0.1 to 3 mm.

8. A cutting assembly according to claim 1 where the first cutting blade comprises the cutting blade that is stationary during operation.

9. A cutting assembly according to claim 1 and comprising at least one first ball bearing this arranged between the first and the cutting blades.

10. A cutting assembly according to claim 9 where said at least one first ball bearing is arranged between first and second guiding recesses formed in the first and second cutting blades, respectively, said first and second guiding recesses extending parallel to the first and second cutting edges.

11. A cutting assembly according to claim 10 where a distance from said first and second guiding recesses to the first and second cutting edges is larger than a distance between each of the first and second slots and the first and the second cutting edges.

12. A cutting assembly according to claim 9 and comprising at least one second ball bearing that is arranged between the first cutting blade and the second cutting blade, wherein the at least one first ball bearing and the at least one second ball bearing are arranged the first and second slots, respectively.

13. A hair clipping device comprising a cutting assembly including:

a first cutting blade having a first cutting edge and a second cutting blade having a second cutting edge, one of said blades being arranged to remain stationary during operation and the other one said blades being arranged to move against the stationary blade during operation to effect said hair clipping, the first cutting blade having a front portion and a rear portion disposed between opposing first and second lateral side edges and including first and second slots aligned with each other and in parallel with the first cutting edge, said first and second slots longitudinally cutting through the first cutting blade from the first and second lateral edges, respectively, to a bridge part disposed between said first and second slots, said bridge part connecting said front portion and said rear portion, said slot and bridge part structure enhancing the ability of portions of the first cutting blade connected to the bridge part to flex in response to an applied force; and a force-applying member mounted in the cutting assembly and coupled to one of the first and second cutting blades for resiliently applying a force urging the portions of the first cutting blade connected to the bridge part and the second cutting blade against each other, thereby compensating for warpages of the first and second butting blades relative to each other.

14. A hair clipping device as in claim 13 where the first and second slots are slits cutting through the first cutting blade from the first and second lateral edges, respectively.

* * * * *